US008327469B2

(12) United States Patent
Curtis

(10) Patent No.: US 8,327,469 B2
(45) Date of Patent: Dec. 11, 2012

(54) PROTECTIVE GARMENT WITH LOW FRICTION CHARACTERISTICS

(75) Inventor: Nicholas J. Curtis, Dayton, OH (US)

(73) Assignee: Lion Apparel, Inc., Dayton, OH (US)

( * ) Notice: Subject to any disclaimer, the term of this patent is extended or adjusted under 35 U.S.C. 154(b) by 711 days.

(21) Appl. No.: 12/420,847

(22) Filed: Apr. 9, 2009

(65) Prior Publication Data

US 2009/0255038 A1 Oct. 15, 2009

Related U.S. Application Data

(60) Provisional application No. 61/043,531, filed on Apr. 9, 2008.

(51) Int. Cl.
*A62B 17/00* (2006.01)

(52) U.S. Cl. ..... 2/458; 2/81; 139/420 R

(58) Field of Classification Search ..... 2/458, 69, 2/81, 93, 97, 272, 455; 139/420 A, 420 R
See application file for complete search history.

(56) References Cited

U.S. PATENT DOCUMENTS 5,209,602 A 5/1993 Godbersen
5,299,602 A 4/1994 Barbeau et al.
5,539,928 A 7/1996 Aldridge
5,691,040 A 11/1997 Barbeau et al.
5,724,673 A 3/1998 Aldridge
5,819,316 A * 10/1998 Aldridge ..... 2/81
5,858,888 A * 1/1999 Underwood et al. ..... 442/286
5,860,163 A 1/1999 Aldridge
5,920,905 A * 7/1999 Aldridge ..... 2/81
5,928,971 A 7/1999 Ellis et al.
6,247,179 B1 6/2001 Underwood et al.
6,430,754 B1 * 8/2002 Taylor et al. ..... 2/458
6,624,096 B2 * 9/2003 Thomas et al. ..... 442/181
7,393,800 B2 * 7/2008 Corner ..... 442/302
2003/0228812 A1 12/2003 Stanhope et al.
2004/0055660 A1 3/2004 Heiman
2004/0152378 A1 * 8/2004 Stanhope et al. ..... 442/5
2005/0186875 A1 * 8/2005 Lilani ..... 442/189
2006/0084337 A1 * 4/2006 Corner et al. ..... 442/203
2006/0143809 A1 * 7/2006 Dunn ..... 2/458

OTHER PUBLICATIONS (EffectsSolidLubricants) Su et al., "Effects of solid lubricants on friction and wear properties of Nomex fabric composites," Mar. 8, 2006, Materials Science and Engineering A 424 (2006) p. 333-339.*
Product literature, "TENCATE Quantum 3D™ Emergency Response", by Southern Mills, Inc., Union City, Ohio (2 pages) (Aug. 16, 2007).
Web page regarding "TENCATE Quantum 3D™," by Southern Mills, Inc., http://www.tencate.com (1 page) (Oct. 13, 2007).

(Continued)

*Primary Examiner* — Khoa Huynh
*Assistant Examiner* — Anna Kinsaul
(74) *Attorney, Agent, or Firm* — Thompson Hine L.L.P.

(57) ABSTRACT

A protective garment including an outer shell and an inner liner coupled to the outer shell and positioned such that the inner liner is positioned between a wearer and the outer shell when the garment is worn. The inner liner includes a base material and a high lubricity material which has a higher lubricity than the base material. The high lubricity material is woven into the base material to form a plurality of discrete contact areas in which a plurality of filaments of the high lubricity material are immediately adjacent to each other.

24 Claims, 4 Drawing Sheets

OTHER PUBLICATIONS

PCT, International Search Report and Written Opinion, PCT/US2009/039985 (Jul. 6, 2009).
PCT, International Preliminary Report on Patentability, International Application No. PCT/US2009/039985 (Oct. 21, 2010).
PCT, (Corrected) International Search Report and Written Opinion, International Application No. PCT/US2009/039985 (Jul. 17, 2009).
Smith, W.C., "High Performance and High Temperature Resistant Fibers—Emphasis on Protective Clothing" (Sep. 21, 1999).
"Celazole® PBI (Polybenzimidazole)," from the website of Plastics International, http://www.plasticsintl.com/datasheets/797942226Celazole_PBI.pdf (retrieved from the Internet on Jul. 25, 2012).
"Polybenzimidazole (PBI) Material Information," from the website of Goodfellow, http://www.goodfellow.com/E/Polybenzimidazole.html (retrieved from the internet on Jul. 25, 2012).
Parsons, E.M. et al., "Impact of woven fabric: Experiments and mesostructure-based continuum-level simulations," *Journal of the Mechanics and Physics of Solids*, 58 (2010) 1995-2021 (see section 3.2, p. 2007-2008).
"Knotting Dyneema®? [VID],"from the website of DMM International, http://dmmclimbing.com/knowledge/knotting-dyneema-vid/ (retrieved from the internet on Jul. 25, 2012).
"Explicit Finite Element Modeling of Multilayer Composite Fabric for Gas Turbine Engine Containment Systems, Phase II. Part 1: Fabric Material Tests and Modeling," Final Report, DOT/FAA/AR-08/37,P1, U.S. Department of Transportation, Federal Aviation Administration, Section 3, pp. 23-25 (Feb. 2009).
EP, Examination Report, European Application No. 09729739.4 (Apr. 25, 2012).

* cited by examiner

PROTECTIVE GARMENT WITH LOW FRICTION CHARACTERISTICS

This application claims priority to U.S. Provisional Application Ser. No. 61/043,531, filed on Apr. 9, 2008, the entire contents of which are hereby incorporated by reference.

The present invention relates to protective garments, and more particularly, to protective garments with a low or reduced friction to increase lubricity.

BACKGROUND

Protective or hazardous duty garments are used in a variety of industries and settings to protect the wearer from hazardous conditions such as heat, flames, smoke, cold, sharp objects, chemicals, liquids, vapors, fumes and the like. In addition, the wearers of such garments are typically placed under physical strain by carrying heavy gear and equipment. Wearers seek to avoid fatigue to remain mentally sharp and physically able to carry out tasks.

Protective garments are often constructed from sturdy and stiff materials to provide sufficient protection. However, the weight and stiffness of these materials may cause frictional engagement with the wearer or the wearer's clothing.

SUMMARY

Accordingly, in one embodiment the present invention is a protective garment with low-friction characteristics, which reduces friction and stress upon the wearer. More particularly, in one embodiment, the invention is a protective garment including an outer shell and an inner liner coupled to the outer shell and positioned such that the inner liner is positioned between a wearer and the outer shell when the garment is worn. The inner liner includes a base material and a high lubricity material which has a higher lubricity than the base material. The high lubricity material is woven into the base material to form a plurality of discrete contact areas in which a plurality of filaments of the high lubricity material are immediately adjacent to each other.

DETAILED DESCRIPTION

Figure 1:
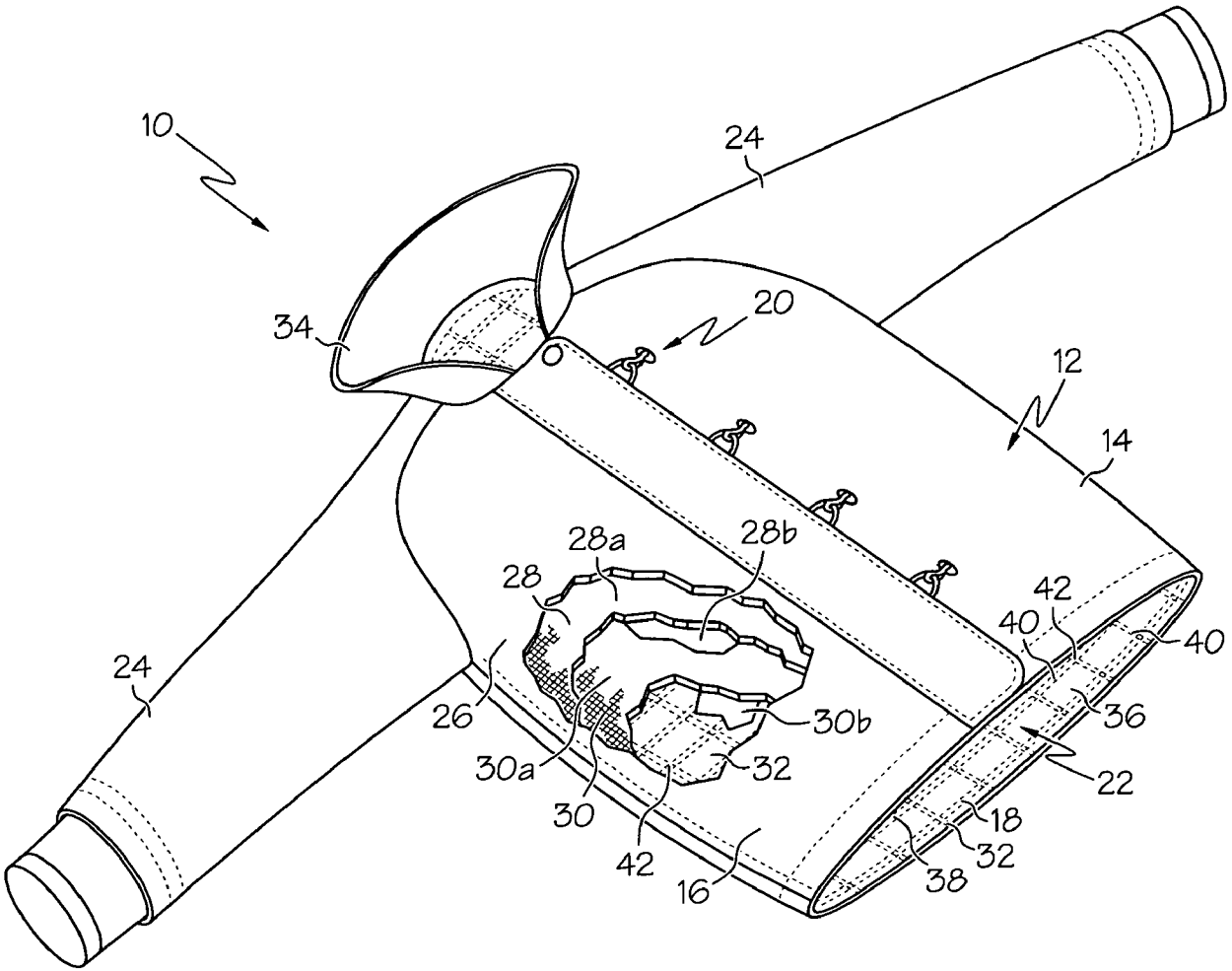
FIG. 1 is a front perspective view of one embodiment of the garment of the present invention, shown in the form of a coat with certain layers cut away for illustrative purposes.

FIG. 1 illustrates a protective or hazardous duty garment in the form of a firefighter's garment, generally designated 10. The garment 10 may include a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO® fastening material), combinations of these components or the like. The body portion 12 may define a torso cavity 22 that is shaped and configured to receive a wearer's torso therein. The garment 10 may include a pair of sleeves 24 coupled to and extending generally outwardly from the body portion 12 and shaped to receive a wearer's arms therein.

The garment 10 may include various layers through its thickness to provide various heat, moisture and abrasion resistant qualities to the garment 10 so that the garment 10 can be used as a protective, hazardous duty, and/or firefighter garment. For example, the garment 10 may include an outer shell 26, a moisture barrier 28 located inside of and adjacent to the outer shell 26, a thermal liner or barrier 30 located inside of and adjacent to the moisture barrier 28, and an inner liner or face cloth 32 located inside of and adjacent to the thermal liner 30.

The outer shell 26 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials. If desired, the outer shell 26 may be coated with a polymer, such as a durable, water repellent finish (i.e. a perfluorohydrocarbon finish, such as TEFLON® finish sold by E. I. Du Pont de Nemours and Company of Wilmington, Del.). The materials of the outer shell 26 may have a weight of, for example, between about five and about ten oz/yd$^2$.

The moisture barrier 28 and thermal liner 30 may be generally coextensive with the outer shell 26, or spaced slightly inwardly from the outer edges of the outer shell 26 (i.e., spaced slightly inwardly from the outer ends of the sleeves 24, the collar 34 and from the lower edge of the garment 10) to provide moisture and thermal protection throughout the garment 10. The moisture barrier 28 may include a semi-permeable membrane layer 28*a* and a substrate 28*b*.

The membrane layer 28*a* may be generally water vapor permeable but generally impermeable to liquid moisture. The membrane layer 28*a* may be made of or include expanded polytetrafluoroethylene ("PTFE") such as GORE-TEX or CROSSTECH materials (both of which are trademarks of W. L. Gore & Associates, Inc. of Newark, Del.), polyurethane-based materials, neoprene-based materials, cross-linked polymers, polyamid, or other materials. The membrane layer 28*a* may have microscopic openings that permit moisture vapor (such as water vapor) to pass therethrough, but block liquids (such as liquid water, body fluids such as blood and bloodborne pathogens, or chemicals) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined. The membrane layer 28*a* may also entirely block vapor, gases, aerosols, etc., and may constitute, for example, neoprene.

The membrane layer 28*a* may be bonded or adhered to a substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight. The substrate 28*b* may be woven, non-woven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal liner 30 may be made of nearly any suitable material (flame resistant, in one embodiment) that provides sufficient thermal insulation. In one embodiment, the thermal liner 30 may include a relatively thick (i.e. between about 1/16"-3/16") batting, felt or needled non-woven bulk or batting material 30*a*. The batting material 30*a* can include aramid fiber batting (such as NOMEX batting), aramid needlepunch material, an aramid non-woven material, an aramid blend needlepunch material, an aramid blend batting material, an aramid blend non-woven material, foam (either open cell or closed cell), or other suitably thermally insulating materials. The batting 30*a* may includes one or more layers or a combination of layers of suitable materials. The batting 30*a* may trap air and possess sufficient loft to provide thermal resistance to the garment 10.

The batting 30*a* may be quilted to a thermal liner face cloth 30*b* which can be a weave of a lightweight aramid material. Thus, either the batting 30*a* alone, or the batting 30*a* in combination with the thermal liner face cloth 30*b*, may be considered to constitute the thermal liner 30. In one embodiment, the thermal liner 30 (or the garment 10 as a whole) may have a thermal protection performance ("TPP") of at least about twenty, and/or the garment 10 as a whole may have a TPP of at least about thirty-five.

In the illustrated embodiment, the thermal liner face cloth 30*b* is located between the batting 30*a* and the face cloth 32. However, the orientation of the thermal liner 30 may be reversed such that the batting 30*a* is located between the thermal liner face cloth 30*b* and the face cloth 32. Moreover, although the moisture barrier 28 is shown as being located between the outer shell 26 and the thermal liner 30, the positions of the moisture barrier 28 and thermal liner 30 may be reversed such that the thermal liner 30 is located between the outer shell 26 and the moisture barrier 28, or various other orientations or configurations may be used. If desired, the thermal liner 30 may be treated with a water-resistant or water-repellent finish.

Figure 2:
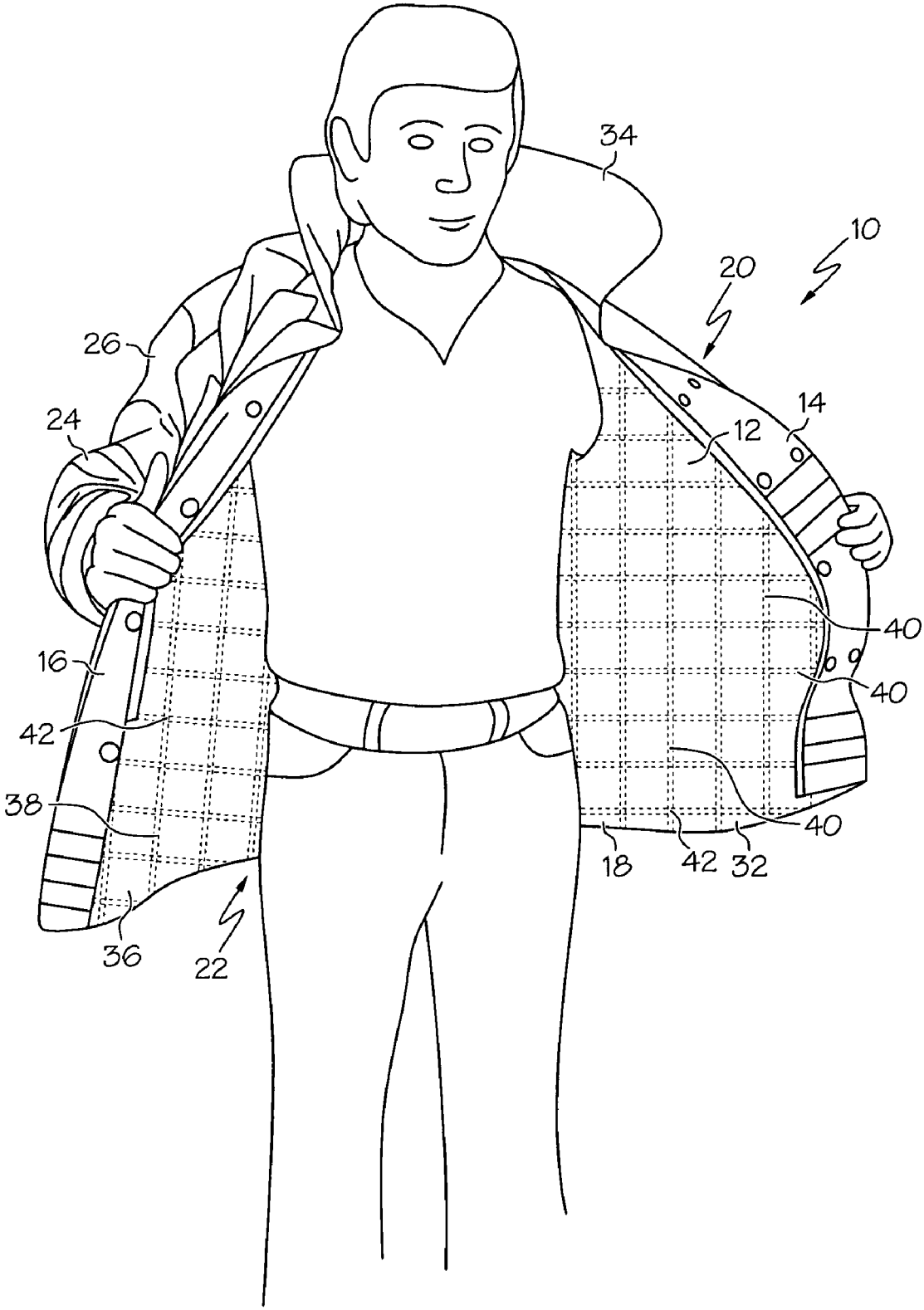
FIG. 2 is a front view of the garment of FIG. 1 being worn and held open to expose the face cloth.

The face cloth 32 may be the innermost layer of the garment 10 (best shown in FIG. 2), located inside the thermal liner 30 and moisture barrier 28. The face cloth 32 can provide a comfortable surface for the wearer and protect the thermal liner 30 and/or moisture barrier 28 from abrasion and wear. The face cloth 32 may be quilted to the adjacent layer (i.e. the thermal liner 30 in the illustrated embodiment).

Each layer of the garment 10, and the garment 10 as a whole, may meet the National Fire Protection Association ("N.F.P.A.") 1971 standards for protective firefighting garments ("Protective Clothing for Structural Firefighting"), also known as the National Fire Protection Association 1971 Standard on Protective Ensembles for Structural Fire Fighting and Proximity Fire Fighting, which are entirely incorporated by reference herein. The NFPA standards specify various minimum requirements for heat and flame resistance and tear strength. For example, in order to meet the NFPA standards, the outer shell 26, moisture barrier 28, thermal liner 30 and face cloth 32 must be able to resist igniting, burning, melting, dripping, separation, and/or shrinking more than 10% in any direction after being exposed to a temperature of 500° F. for at least five minutes. Furthermore, in order to meet the NFPA standards, all combined layers of the garment 10 must provide a thermal protective performance rating of at least thirty-five.

Figure 3:
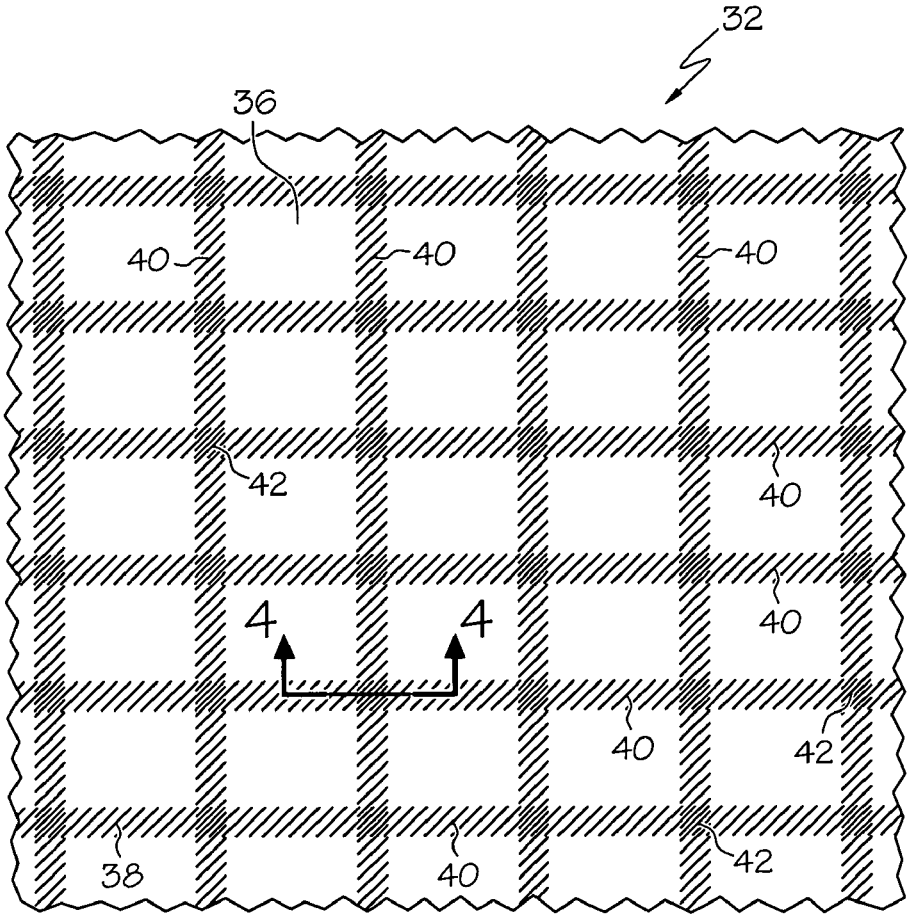
FIG. 3 is a detailed view of the face cloth of the garment of FIG. 1.
Figure 4:
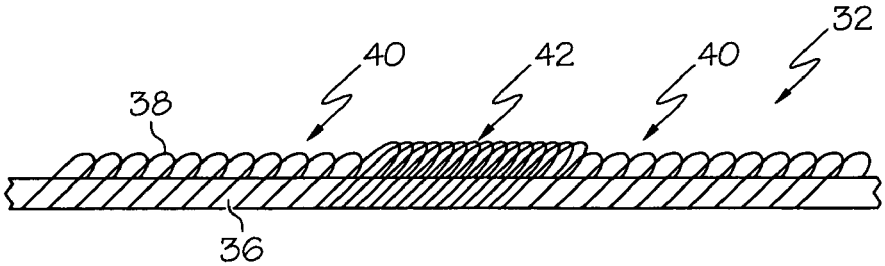
FIG. 4 is a cross section taken along line 4-4 of FIG. 3.
Figure 5:
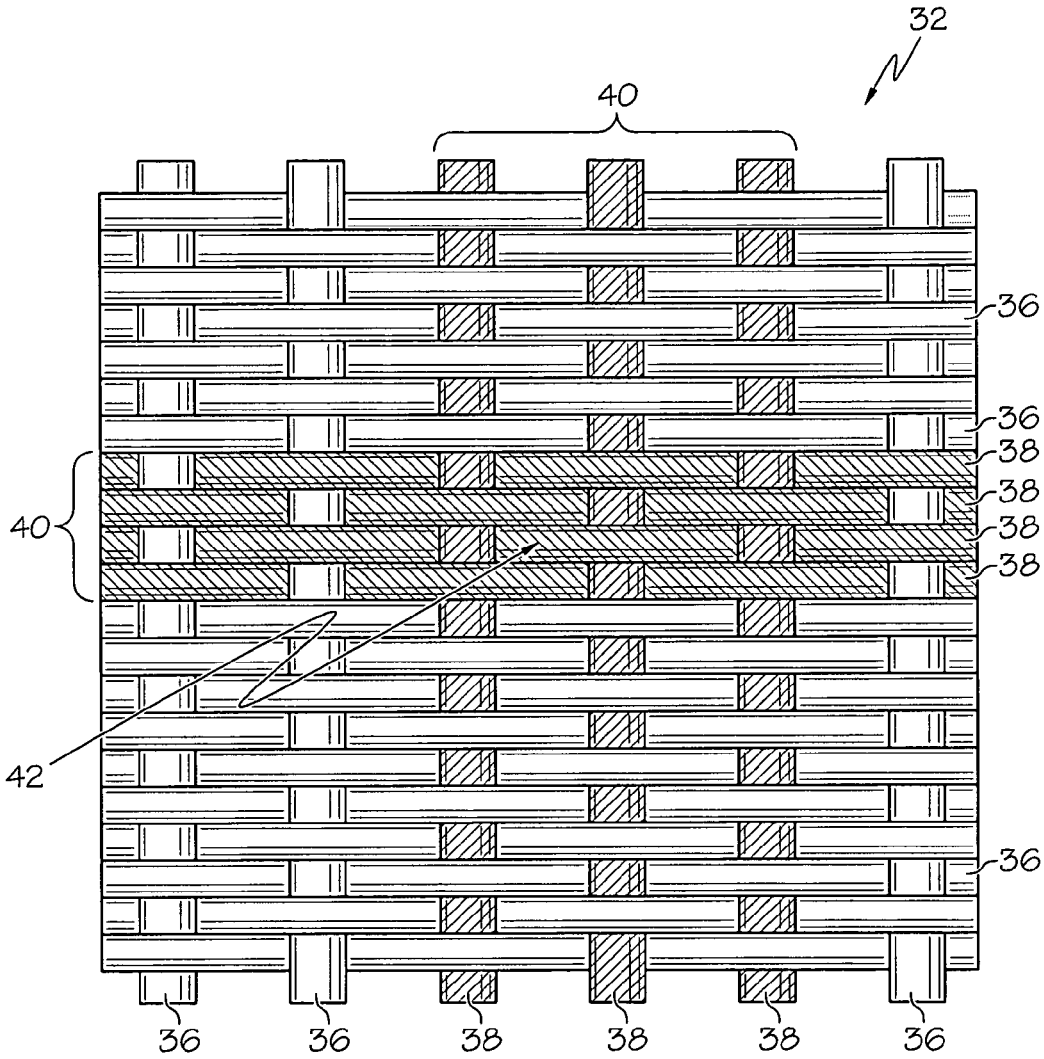
FIG. 5 is a detailed view of a contact area and surrounding areas of the face cloth of FIGS. 1-4.
Figure 6:
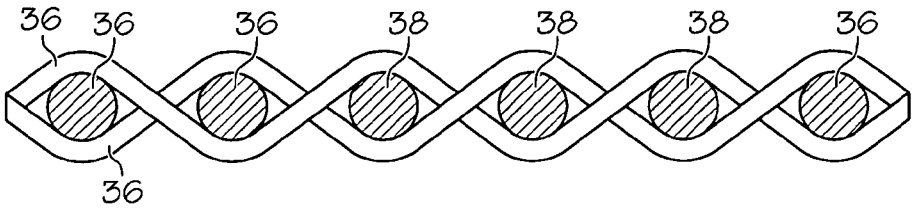
FIG. 6 is an end view of the face cloth of FIG. 5.

As best shown in FIGS. 3-5 the face cloth 32 may include a base material 36 with a low friction/high lubricity material 38 interwoven into or coupled to the base material 36. The base material 36 can be made of any of a variety of materials, such as a woven, flame resistant NFPA compliant material. In one embodiment, the base material 36 is spun meta-aramid material, such as NOMEX® fiber sold by E. I. du Pont de Nemours and Company of Wilmington, Del., but could also be spun para-aramid fibers such as KEVLAR®, aromatic polyimide-amide fibers such as KERMEL®, cotton or viscose cellulosic fibers, flame resistant viscose fibers such as Lenzing FR™ fiber, polytetrafluoroethylene fibers, Kynol, carbonized acrylics or other pre-oxidized fibers, acrylics, modacrylics, as well as other fibers having flame resistant properties or being capable of accepting flame resistant treatments and/or finishes. A mixture of fibers may be used to create the base material 36 and the mixture may be constructed by blending the fibers into yarns, or by interweaving yarns of different fibers together into a material. The base material 36/face cloth 32 can take any of a variety of textile forms, such as a plain weave, or various other woven or other forms such as a twill weave, oxford weave or satin weave, or any of the other constructions that are variations on these fundamental techniques.

The high lubricity material 38 may be woven into, coupled to, or otherwise incorporated into or coupled to the face cloth 32/base material 36. The high lubricity material 38 can be any of a variety of materials, such as a filament yarn or filament materials (including monofilament or multi-filament materials) that are flame/fire resistant and NFPA compliant. For example, the high lubricity material 38 can be a filament form of meta-aramid material (such as NOMEX® material), a para-aramid material (such as KEVLAR® material), aromatic polyimide-amide filaments (such as KERMEL® thermostable organic polymer material), PTFE, polyetheretherketone (PEEK), nylon, fire-resistant viscose, chemically altered spun yarn, or combinations of these materials.

The high lubricity material 38 can be woven into the base material 36 in a variety of manners. For example, in one embodiment the high lubricity material 38 is woven into the base plain weave material 36 using a twill weave pattern for the filament yarns 38. The use of a twill weave pattern helps to ensure that a relatively high percentage of the high lubricity material 38 (i.e. greater than 50%) is facing the desired direction, such as facing the wearer of the garment 10. For example, a 2/1 twill weave pattern, 3/1 twill weave pattern, or the like may be utilized. In addition, various other weaving patterns may be utilized in order to ensure that more of the high lubricity material 38 faces one side of the face cloth 32 than the other side.

As shown in FIG. 3, the high lubricity material 38 can be woven into or incorporated into the base material 36 such that the high lubricity material 38 is shaped in a pattern. In the illustrated embodiment, the pattern is a "window-pane" pattern formed by a set of parallel/perpendicular lines or generally rectangular strips 40 that intersect another set of parallel lines 40 at a ninety degree angle to define a series of squares. This pattern produces a plurality of points of intersection, or equally-spaced contact points or contact areas 42, of the high lubricity material 38 where one line 40 overlaps with, or overlies, the other line 40. In the areas outside of the lines 40/contact areas 42 (which may constitute a majority of the surface area), the face cloth 32 may lack, or substantially lack, any high lubricity material 38.

The high lubricity material 38 may be woven such that the portions of the lines 40 (outside of a contact point 42) constitute about 50%, or less than about 50%, of the cloth 32 in that line 40. However at each contact point 42 high lubricity material 38 may constitute at least about 75%, or substantially 100% or 100% of the face cloth 32. In other words, at each contact point 42 a plurality of filaments of the high lubricity material 38 may be positioned immediately adjacent to each other, with no intervening fibers, and contact an adjacent high lubricity filament 38 to form a generally continuous contact point 42 made of high lubricity material 38. Since a contact point 42 represents the overlap between two lines 40, the density of the high lubricity material 38 at a contact point 42 can be about double the density of the high lubricity material 38 in a line 40.

This concept is conceptualized in FIG. 3, in which the white portions of that figure represent the base material 36, and the angled black lines represent a stitch of the high lubricity material 38 (although the "density" of the high lubricity material in each line 40 and contact area point 42 is not necessarily to scale). In this manner, each contact point 42 may provide a raised area (as shown in FIG. 4), and/or a continuous surface of the high lubricity material 38, which is configured to contact the wearer, or the wearer's clothing, to reduce friction between the garment 10 and the wearer/wearer's clothing. Each contact point 42 may be slightly raised above a plane defined by the base material 36. In addition, each line 40 of high lubricity material 38 offers reduced friction at locations away from each contact point 42.

FIG. 5 illustrates one particular manner in which the various fibers or yarns of the high lubricity material 38 can be woven into the fibers or yarns of the base material 36, using a plain weave in the illustrated embodiment. In this case, each line 40 constitutes three or four fibers or yarns of the high lubricity material 38, although this number can vary as desired. In one embodiment, however, each line 40 constitutes at least three fibers or yarns of high lubricity material 38. In the illustrated embodiment the fibers or yarns of high lubricity material 38 make up the entirely of the face cloth 32 at each contact point 42.

In the embodiment shown in FIG. 5, the fibers or yarns of high lubricity material 38 are incorporated into both the warp and the filler (weft) of the woven material 32. In other words, the fibers or yarns of high lubricity material 38 are woven in at least two non-parallel, or generally perpendicular, directions of the face cloth material 32, which may help to improve the lubricity of the face cloth 32. In particular, when the face cloth 32 is moved in any particular direction, the perpendicular nature of the intersecting lines 40 ensure that some lines 40 are generally perpendicular to the movement, and some lines are generally parallel to the movement, to reduce friction.

Any of a variety of patterns of lines 40, which produce the contact points 42, may be utilized. For example, besides the window-pane pattern shown in FIGS. 3 and 5, a diamond pattern, rectangular pattern, or triangles, circles, curved lines or other geometric or non-geometric shapes or patterns may be utilized. In the illustrated embodiment, each line 40 has a thickness (i.e., in the left-to-right or up-and-down direction of FIGS. 3 and 5) of between about 1/32" to about 1/4" (about 1/16" in one embodiment) and a spacing therebetween of between about 1/8" and about 1/2" (about 1/4" in one embodiment). Each contact point 42 may have a surface area of between about 0.004 square inches and about 0.0625 square inches (about 0.0156 square inches in one embodiment).

In one embodiment, the high lubricity material 38 constitutes less than about 25% by weight of the face cloth 32, or between about 10% and about 50% of the weight of the face cloth 32. The contact points 42 may constitute between about 1 percent and about 50 percent, and more particularly between about 5 percent and about 30 percent (about 15 percent in one embodiment) of the surface area of the face cloth 32. The percent of surface area of the contact points 42 may exceed the percent of weight of the filament/high lubricity material 38 due to the nature of the weave, such as use of a twill or other weave, as noted above, in which more of the high lubricity material 38 faces one side of the face cloth 32. If the contact points 42/high lubricity material 38 constitute too high of a percentage of the surface area, then the cost of the face cloth 32 is increased. On the other hand, if the contact points 42/high lubricity material 38 constitute too low a percentage of the face cloth 32, then insufficient lubricity may be provided.

As noted above, the high lubricity material 38, and in particular the contact points 42, significantly reduce friction between the garment 10 and the wearer. This helps to improve ease of movement and reduces stress on the wearer which allows the wearer to move and react quickly, conserve energy, and extend his or her endurance. Moreover, the garment 10 provides these benefits with relatively minimal usage of the high lubricity material 38. In particular the high lubricity material 38 may be relatively expensive and scarce. Using the arrangement disclosed herein, the face cloth 32 is provided with high lubricity/low friction qualities with relatively little use of high lubricity material 38.

The high lubricity material 38 may be of a higher lubricity than the base material 36 by at least about 50%. The lower the static friction of a material, the higher its lubricity, or "slipperiness." For example, in one embodiment, due to the high lubricity of the high lubricity material 38, the static friction of the face cloth 32, as a whole, is less than about 0.33 Newtons, or as low as about 0.25 Newtons or less. In contrast, face cloth materials utilizing the same quantity of high lubricity material in a more evenly distributed construction may exhibit static friction values ranging from about 0.33 Newtons to about 0.75 Newtons.

When the high lubricity material 38 is a filament material and the base material 36 is made of spun fibers, over time and launderings the base material 36 tends to shrink relative to the high lubricity material 38 since spun fibers may shrink, but filament material generally does not. This causes the raised nature of the contact points 42 to become even more pronounced, which increases the lubricity of the face cloth 32 as a whole. In addition, the shrinking of the base material 36 allows the face cloth 32 to trap more air between the face cloth 32 and the wearer as the base material 36 is pulled away from an adjacent thermal liner 30 (similar to the cooling effect of a garment made of seersucker material). Accordingly the face cloth 32 may help to increase the thermal insulation qualities of the garment 10.

It should be noted that the material/face cloth 32 described herein can be used in a variety of garments. For example, the particular garment 10 described above for illustrative purposes includes an outer shell 26, a moisture barrier 28 and a thermal liner 30. However, the garment 10 need not necessarily include a moisture barrier 28 and/or thermal liner 30, and/or may include additional layers or features not specifically described herein. Moreover, if the garment 10 does include a moisture barrier 28 and/or thermal liner 30, the moisture barrier 28 and/or thermal liner 30 can differ significantly in materials, characteristics, arrangement and/or design from the moisture barrier 28 and/or thermal liner 30 described herein. For example, if desired the face cloth 32 described herein can be used with nearly any garment, including more general use garments that are not necessarily firefighter or protective garments.

The face cloth 32 may also be used in a variety of garments besides coats. For example the face cloth 32 may be utilized in trousers, vests, hoods, jump suits, socks, gloves, hats, etc. In addition, the face cloth 32 need not necessarily be used as the inner most-layer of the garment. Instead, the face cloth 32 may be utilized as an intermediate layer of a garment to decrease friction between the various layers thereof, as disclosed in, for example, U.S. Pat. Nos. 5,539,928, 5,724,673, and 5,819,316, the entire contents of which are hereby incorporated by reference. For example, the material of the face cloth 32 described herein (or at least the pattern and contact points 42 of the high lubricity material 38) may be used as or on the moisture barrier substrate 28*b* and/or the thermal liner face cloth 30*b* described herein, or other layers described herein.

When the face cloth 32 is used as an intermediate layer, it reduces friction between the various layers and thus decreases the amount of work required by the wearer to move and bend the garment 10. The pattern and contact of the high lubricity material 38 may extend entirely through the associated layer, or may exist only in strategic parts thereof (i.e. at the elbows, shoulders, knees, hips, or other joints or areas of high friction).

Although the invention is shown and described with respect to certain embodiments, it should be clear that modifications will occur to those skilled in the art upon reading and understanding the specification, and the present invention includes all such modifications.

What is claimed is:

1. A protective garment comprising:

an outer shell; and an inner liner coupled to said outer shell and positioned such that said inner liner is positioned between a wearer and said outer shell when said garment is worn, the inner liner including a base material and a high lubricity material which has a lubricity that is higher than the base material by at least about 50%, wherein the high lubricity material is woven into the base material to form a plurality of discrete contact areas in which a plurality of filaments of the high lubricity material are positioned immediately adjacent to each other;

wherein said inner liner includes a plurality of strips formed by the high lubricity material woven into the base material, and wherein each contact area is positioned at the intersection of at least two of said strips; wherein the contact area comprises at least two separate warp fibers or yarns of high lubricity material each being individually woven with at least two separate weft fibers or yarns of high lubricity material.

2. The garment of claim 1 wherein an upper surface of each contact area is positioned above a plane defined by said base material.

3. The garment of claim 1 wherein said high lubricity material is a multifilament material.

4. The garment of claim 1 wherein each discrete contact area is spaced apart from any adjacent contact areas.

5. The garment of claim 1 wherein each strip comprises a plurality of generally parallel, adjacent fibers of said high lubricity material.

6. The garment of claim 1 wherein the density of the high lubricity material at a contact area is about double the density of the high lubricity material in an associated one of said strips outside of a contact area.

7. The garment of claim 1 wherein said liner substantially lacks any high lubricity material in areas other than said strips or said contact areas.

8. The garment of claim 1 wherein said inner liner constitutes 100% high lubricity material at each contact area.

9. The garment of claim 1 wherein said base material comprises a plurality of yarns oriented generally perpendicular to each other and arranged in a grid.

10. The garment of claim 1 wherein said high lubricity material shrinks less than said base material upon laundering.

11. The garment of claim 1 wherein said base material and said high lubricity material are each flame and fire resistant, and comply with requirements specified in National Fire Protection Association 1971 Standard on Protective Ensembles for Structural Fire Fighting and Proximity Fire Fighting.

12. The garment of claim 1 wherein the contact areas collectively constitute between about 5 percent and about 30 percent of the surface area of the associated side of the inner liner.

13. The garment of claim 1 wherein the associated side of said inner liner has a static friction of less than about 0.33 Newtons.

14. The garment of claim 1 wherein said garment meets National Fire Protection Association 1971 Standard on Protective Ensembles for Structural Fire Fighting and Proximity Fire Fighting.

15. The garment of claim 1 wherein said outer shell resists igniting, burning, melting, dripping or separation when exposed to a temperature of 500° F. for at least five minutes.

16. The garment of claim 1 further comprising a moisture barrier positioned between said inner liner and said outer shell, said moisture barrier being made of a material that is generally liquid impermeable and generally moisture vapor permeable.

17. The garment of claim 1 further comprising a thermal liner positioned between said inner liner and said outer shell, wherein said thermal liner has a thermal protection performance of at least about twenty.

18. The garment of claim 1 wherein the inner liner is the innermost layer of the garment and said contact areas are configured and positioned to face a wearer.

19. The garment of claim 1 wherein the inner liner is positioned and configured such that said contact areas face another liner, or said outer shell, of said garment.

20. A protective garment comprising:

an outer shell; and an inner liner coupled to said outer shell and positioned such that said inner liner is positioned between a wearer and said outer shell when said garment is worn, the inner liner including a base material and a high lubricity material which has a lubricity that is higher than the base material by at least about 50%, wherein the high lubricity material is woven into the base in two non-parallel directions to increase the lubricity of said inner liner such that a plurality of discrete contact areas are formed in which a plurality of filaments, at least two separate warp filaments and two separate weft filaments, of the high lubricity material are immediately adjacent to each other in a plain weave.

21. The garment of claim 16 wherein said inner liner constitutes 100% high lubricity material at each contact area, and wherein said inner liner lacks any high lubricity material in a majority of a surface area thereof.

22. A garment layer including: a base material; and a high lubricity material which has a lubricity that is higher than the base material by at least about 50%, wherein the high lubricity material is woven into the base material to form a plurality of discrete contact areas in which a plurality of filaments, at least two separate warp filaments and two separate weft filaments, of the high lubricity material are immediately adjacent to each other and each are individually woven with one another to form substantially continuous contact areas.

23. The layer of claim 18 wherein said layer constitutes 100% high lubricity material at each contact area, and wherein said layer lacks any high lubricity material in a majority of a surface area thereof.

24. A method for making a protective garment comprising: accessing a garment layer including a base material; and weaving filaments of a high lubricity material into the base material to form a plurality of discrete, spaced-apart substantially continuous contact areas; wherein each filament of high lubricity material contacts an adjacent filament of high lubricity material, wherein said high lubricity material has a higher lubricity than the base material by at least about 50%, and the contact areas comprise at least two separate warp filaments and two separate weft filaments of the high lubricity material and each of the at least two separate warp and weft filaments are individually woven with one another.

* * * * *